US007140901B2

(12) United States Patent
Lin et al.

(10) Patent No.: US 7,140,901 B2
(45) Date of Patent: Nov. 28, 2006

(54) BGA CONNECTOR ASSEMBLY

(75) Inventors: Nick Lin, Tu-Cheng (TW); Yu-Chen Chen, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/293,972

(22) Filed: Dec. 5, 2005

(65) Prior Publication Data

US 2006/0121764 A1 Jun. 8, 2006

(30) Foreign Application Priority Data

Dec. 3, 2004 (TW) ..... 93219492 U

(51) Int. Cl.
*H01R 13/62* (2006.01)

(52) U.S. Cl. ..... 439/331; 439/73

(58) Field of Classification Search ..... 439/131, 439/73, 330, 680, 70

See application file for complete search history.

(56) References Cited

U.S. PATENT DOCUMENTS 3,458,794 A * 7/1969 Bohnstedt et al. ..... 320/111
4,433,886 A * 2/1984 Cassarly et al. ..... 439/65
4,697,070 A * 9/1987 Kai ..... 219/521
5,023,396 A * 6/1991 Bartee et al. ..... 174/48
5,082,450 A * 1/1992 Warren et al. ..... 439/102
5,135,406 A * 8/1992 Ishikawa ..... 439/131
5,302,853 A * 4/1994 Volz et al. ..... 257/707
5,401,178 A * 3/1995 Liu ..... 439/131
5,485,351 A * 1/1996 Hopfer et al. ..... 361/704
5,628,641 A * 5/1997 Hahn ..... 439/131
6,275,002 B1 * 8/2001 Chen ..... 320/111
6,413,111 B1 * 7/2002 Pickles et al. ..... 439/342
6,478,588 B1 * 11/2002 Howell et al. ..... 439/135
6,533,592 B1 * 3/2003 Chen et al. ..... 439/135
6,632,098 B1 * 10/2003 Wong et al. ..... 439/131
6,743,039 B1 * 6/2004 Shirai et al. ..... 439/342
2003/0143884 A1 * 7/2003 Kung et al. ..... 439/342
2004/0032720 A1 * 2/2004 McHugh et al. ..... 361/719
2004/0259407 A1 * 12/2004 Chiang ..... 439/331
2004/0266245 A1 * 12/2004 Liao ..... 439/331
2005/0032408 A1 * 2/2005 Liao et al. ..... 439/331
2005/0233628 A1 * 10/2005 Yang et al. ..... 439/331

* cited by examiner

*Primary Examiner*—Tulsidas C. Patel
*Assistant Examiner*—Vladimir Imas
(74) *Attorney, Agent, or Firm*—Wei Te Chung

(57) ABSTRACT

Disclosed is a BGA connector assembly including an insulative housing (11) with a plurality of terminals (15) in electrical connection with corresponding solder balls (3) that extend from a surface of the housing. The solder balls form a soldering region (30) for attachment to a printed circuit board. The whole electrical connector assembly has a center of gravity biased from a center of the soldering region, and at least one recess (111) is formed in the housing. The at least one recess prevents the connector assembly from becoming inclined with respect to the printed circuit board when the solder balls are attached to the printed circuit board.

20 Claims, 2 Drawing Sheets

BGA CONNECTOR ASSEMBLY

BACKGROUND OF THE INVENTION

1. Field of the Invention

The present invention relates to electrical connectors, especially to ball grid array (BGA) connectors having a plurality of solder balls for surface mount to printed circuit boards.

2. Background of the Invention

Various types of conventional electrical connectors are known for electrically connecting a chip package, such as a CPU, with a circuit board, such as a printed circuit board.

One of the widely-known and used-friendly electrical connectors is a BGA connector, particularly utilized for electrically connecting the chip package with the PCB. The BGA connector generally has a base housing defining a central hole surrounded by a plurality of passageways arranged in a matrix. A plurality of terminals are inserted into the passageways, and have first ends thereof connected to the printed circuit board via an array of solder balls extending from a bottom surface of the housing, and second opposite ends connected to conductive elements of the chip package mounted on the housing. Typically, the conductive elements are in form of land grid array serving as electrodes for connecting the terminals on the base housing. With the current chip package, such as a CPU, to be required operating at higher speeds, the number of lands is extremely large, and thus connection resistance between the lands and the terminals is very great.

There are several solutions developed to overcome this problem. One of the solutions is provided with a power assistance mechanism including a stiffener, a lever, a clip and etc. The stiffener generally defines an opening to grasp a periphery of the housing. The clip and the lever respectively disposed at two ends of the stiffener or the housing to jointly press the CPU chip onto the housing to make electrically connection between the lands of the CPU chip and the terminals on the base housing.

Since the power assistance mechanism is mainly made of metal and may have a dissymmetrical configuration, particularly due to the lever, which contribute to the weight of the power assistance mechanism, the center of gravity of the BGA connector tends to be at a position biased toward the lever side or a heavier connector end portion, as opposed to a center of the array of solder balls of the terminals that are soldered to the printed circuit board.

Due to the positional misalignment between the center of the array of solder balls and the center of gravity of the BGA connector, during reflow soldering of the BGA connector to the printed circuit board, the heavier connector end portion or the lever side is caused to rotate toward the printed circuit board, thereby causing the lighter connector end portion on the opposite side to be separated from the printed circuit board. Thus, the BGA connector may be mounted on the printed circuit board at an inclination, thereby causing electrical connection failure.

SUMMARY OF THE INVENTION

In order to resolve the existing issues encountered by the industry, the inventor provides the following solutions so as to overcome the shortcoming of the existing design. According to one of the preferred embodiments, an electrical connector assembly is provided including an insulative housing with a plurality of terminals in electrical connection with corresponding solder balls that extend from a surface of the housing. The solder balls form a soldering region for attachment to a printed circuit board. The whole electrical connector assembly has a center of gravity biased from a center of the soldering region, and at least one recess is formed in the housing. The at least one recess prevents the connector assembly from becoming inclined with respect to the printed circuit board when the solder balls are attached to the printed circuit board.

Other features and advantages of embodiments of the present invention will become more apparent to those skilled in the art upon examination of the following drawing and detailed description of preferred embodiments, in which:

DETAILED DESCRIPTION OF THE PREFERRED EMBODIMENT

Reference will now be made to the drawings to describe the preferred embodiment of the present invention in detail.

Figure 1:
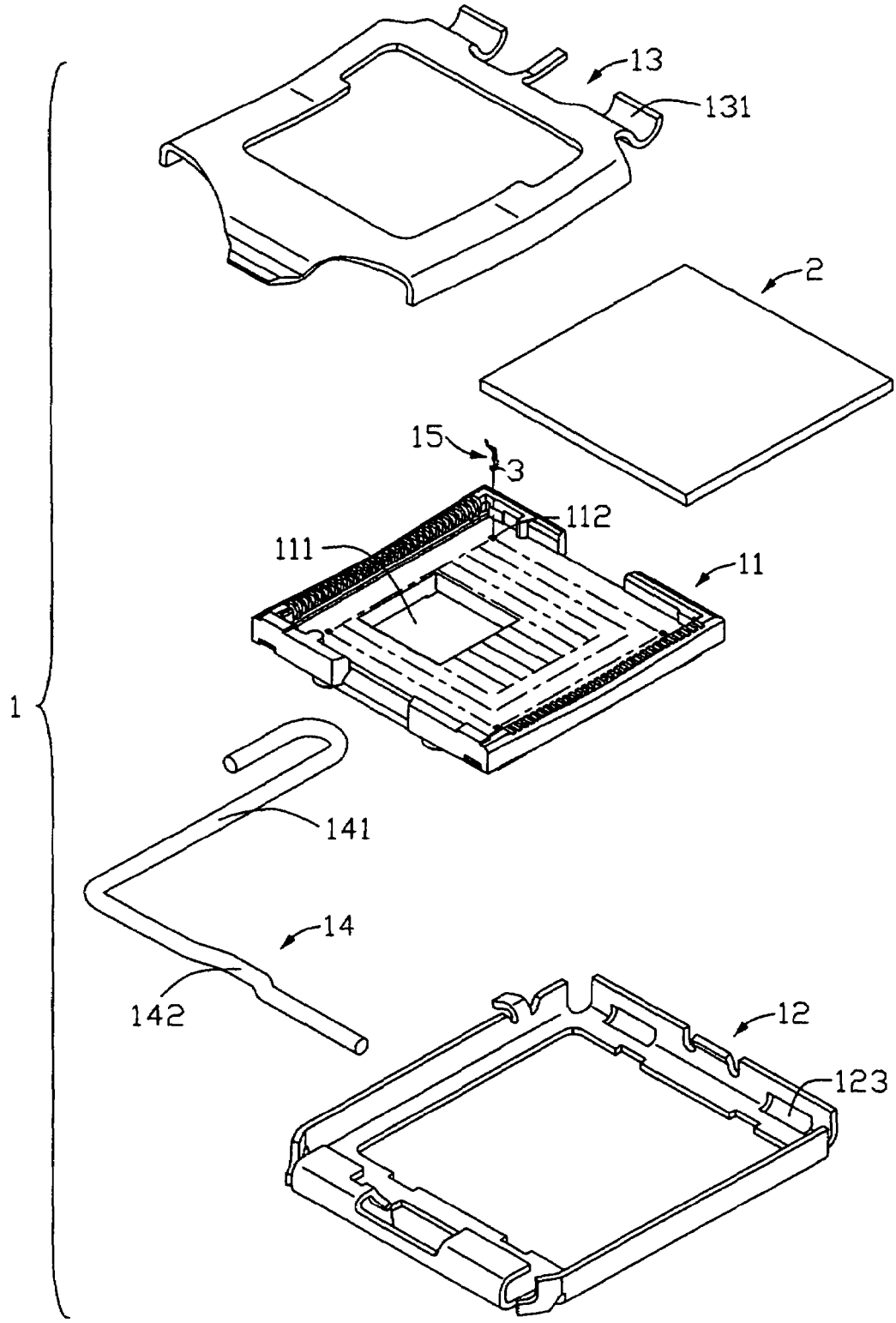
FIG. 1 is an exploded isometric view of an electrical connector assembly in accordance with a preferred embodiment of the present invention.
Figure 2:
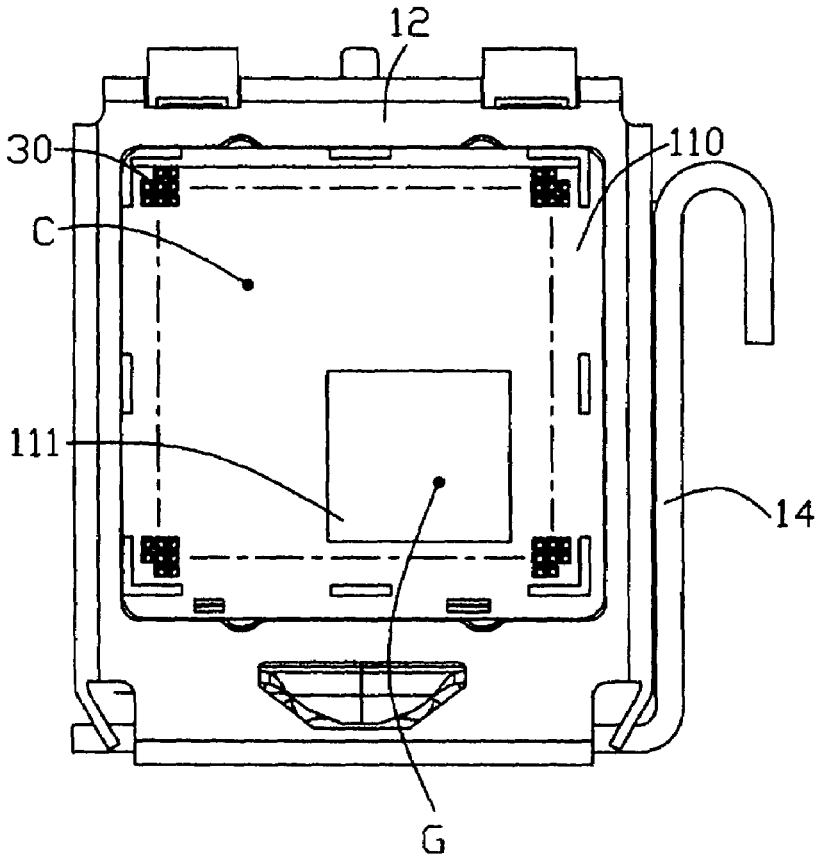
FIG. 2 is an assembled view of the electrical connector assembly of FIG. 1, but showing the electrical connector assembly inverted.

Referring to FIGS. 1 to 2, according to the preferred embodiment of the invention, a BGA electrical connector assembly 1 is provided for electrical connection to a chip package 2 and a printed circuit board (not shown). The electrical connector assembly 1 includes an insulative housing 11 and a stiffener 12 disposed around the housing 11 for reinforcing the housing. A cover member or clip 13 and a lever 14 are essentially pivotally moved about longitudinal ends of the housing 11, respectively. In the present embodiment, the cover 13 and the lever 14 are preferably pivotally mounted onto two opposite ends of the stiffener 12. The cover 13 and the lever 14 cooperate with each other to lock the cover 13 or the connector assembly 1 in a substantially horizontally locked position. In the present embodiment, the stiffener 12, the cover 13 or the lever 14 is considered as part of a power assistance mechanism. However, in other embodiments, the BGA electrical connector assembly 1 may be provided with any suitable power assistance mechanism, for example, including a cam thereof.

The lever 14 further includes a driving member 141 and a locking member 142 linked thereto. In the preferred embodiment, the driving member 141 is disposed on a side of the housing 11 for driving the lever 14 to lock the cover 13 in the substantially horizontally locked position, while the locking member 142 is supported by one side wall of the stiffener 12 so as to be pivotally mounted onto one end of the stiffener 12. Further, the cover 13 is pivotally mounted onto the other end of the stiffener 12 by catches 131 engaging with slots 123.

The housing 11 is provided with at least one recess 111 surrounded by a plurality of terminal receiving passageways 112. The recess 111 extends through the housing 11, and is located adjacent the driving member side while not defined in the middle of the housing 11. The recess 111 is preferably of a square shape, and arranged such that gravity generated by the connector assembly 1 is substantially equal to surface tension generated by a soldering region 30 so as to prevent the connector assembly from becoming inclined with respect to the printed circuit board when solder balls 3 are attached to the printed circuit board, to be later described. It should be noted that, the housing 11 may be provided with any suitable recess or recesses having any other shape/configuration thereof, as long as said recess or recesses can achieve its desired effect that prevent the whole connector assembly from becoming inclined with respect to the printed circuit board when the solder balls 3 are attached to the printed circuit board.

The passageways 112 are formed in the housing except for the recess 111, and therefore have a dissymmetrical configuration. A plurality of terminals 15 is inserted into the passageways 112. Each of the terminals 15 is in electrical connection with a solder ball 3. The solder balls 3 extend from a bottom surface 110 of the housing 11, and form a ball grid array or soldering region 30 defining a center of surface tension designated as C when the solder balls 3 are attached to the printed circuit board.

Referring particularly to FIG. 2, in assembly of the BGA connector assembly, the housing 11 is pre-loaded into the stiffener 12 with the terminals assembled therein. The cover 13 and the lever 14 are pivotally mounted onto two ends of the stiffener 12 by the catches 131 and the locking member 142. In use, the cover 13 and the lever 14 are driven to cooperate with each other to lock the connector assembly 1 in a substantially horizontally locked position.

During reflow soldering of the BGA connector to the printed circuit board, the BGA connector assembly with the recess 111 formed in the housing 11 can prevent the connector assembly from becoming inclined with respect to the printed circuit board when solder balls 3 are attached to the printed circuit board. More specifically, the whole connector assembly 1 has a center of gravity designated as G, while the soldering region 30 has the center of surface tension designated as C when the solder balls 3 are attached to the printed circuit board. When the BGA connector assembly 1 is mounted on the printed circuit board with the solder balls 3 attached thereto, the gravity generated at G by the connector assembly 1 is substantially counterbalanced with the surface tension generated at C by the soldering region 30, and thus the BGA connector assembly 1 is held balance and substantially in parallel with the printed circuit board. Therefore, the connector assembly 1 can be effectively prevented from becoming inclined with respect to the printed circuit board.

As stated above, the recess 111 of the present embodiment is defined adjacent the driving member 141 side, because the center of gravity of the BGA connector tends to be biased toward the lever 14 side if no recess 111 is formed in the housing 11. However, in other embodiments, the housing 11 is formed with a recess or recesses adjacent the heavier connector end portion, if the center of gravity of the BGA connector tends to be biased toward the heavier connector end portion before the recess or recesses are formed in the housing 11.

It can be noted that the invention essentially focuses upon the relationship among the centers of the soldering region, the gravity and the geometry of the subject connector. In this embodiment, the geometry center of the whole connector is roughly located around a geometry center of the housing. It is also noted that the weight of the removed housing material due to forming the recess somewhat influences the gravity center of the whole connector. Anyhow, it may not be a primary factor of the biasing tendency in comparison with the asymmetric arrangement among the metallic stiffener, cover and lever.

While the present invention has been described with reference to specific embodiments, the description of the embodiments is illustrative, but not to be construed as limiting the invention. Various of modifications to the present invention can be made to the preferred embodiments by those skilled in the art without departing from the true spirit and scope of the invention as defined by the appended claims.

What is claimed is:

1. A ball grid array (BGA) connector assembly comprising:

an insulative housing having a plurality of terminals in electrical connection with corresponding solder balls extending from a bottom surface of the housing to form a soldering region for attachment to a printed circuit board;

a driving member disposed on a side of the housing and adapted for cooperating with a cover to lock the connector assembly in a locked position; and the connector assembly including the driving member thereof, having a center of gravity biased from a center of the soldering region; wherein at least one recess formed in the housing and adjacent said driving member side to prevent the connector assembly from becoming inclined with respect to the printed circuit board when the connector assembly is in a locked position and its solder balls are attached to the printed circuit board.

2. The BGA connector as recited in claim 1, further comprising a lever, the lever and the cover are essentially pivotally moved about opposite ends of the housing, respectively.

3. The BGA connector as recited in claim 2, the lever comprises a locking member and the driving member linked thereto, the locking member is essentially pivotally moved about one end of the housing.

4. The BGA connector as recited in claim 1, further comprising a stiffener disposed around the housing for reinforcing the housing.

5. The BGA connector as recited in claim 1, said at least recess is not defined in the middle of the housing.

6. The BGA connector as recited in claim 5, said at least recess is of a substantially square shape.

7. The BGA connector as recited in claim 1, said at least recess is arranged extending through the housing.

8. The BGA connector as recited in claim 7, the housing is provided with a plurality of terminal receiving passageways in the housing except for said at least one recess.

9. An electrical connector assembly comprising:

an insulative housing having a plurality of terminals in electrical connection with corresponding solder balls extending from a surface of the housing to form a soldering region for attachment to a printed circuit board; and the electrical connector assembly having a center of gravity biased from a center of the soldering region; wherein at least one recess formed in the housing to prevent the connector assembly from becoming inclined with respect to the printed circuit board when the solder balls are attached to the printed circuit board.

10. The electrical connector assembly as recited in claim 9, further comprising a lever and a cover, the lever and the cover are essentially pivotally moved about opposite ends of the housing, respectively.

11. The electrical connector assembly as recited in claim 9, further comprising a stiffener disposed around the housing for reinforcing the housing.

12. The electrical connector assembly as recited in claim 9, said at least recess is not defined in the middle of the housing.

13. The electrical connector assembly as recited in claim 12, said at least recess is of a substantially square shape.

14. The electrical connector assembly as recited in claim 9, said at least recess is arranged extending through the housing.

15. The electrical connector assembly as recited in claim 9, the housing is provided with a plurality of terminal receiving passageways in the housing except for said at least one recess.

16. An electrical connector assembly comprising:

an insulative housing having a plurality of terminals in electrical connection with corresponding solder balls extending from a surface of the housing to form a soldering region for attachment to a printed circuit board; and the electrical connector assembly having a center of gravity offset from a center of geometry; wherein the soldering region is arranged to be asymmetrical with regard to the center of geometry so as to result in the combined surface tension force, which is derived from solidification of the melted solder balls, counterbalancing the tilting tendency derived from an offset between the center of gravity and the center of geometry, thus assuring even solidification of the melted solder balls.

17. The electrical connector assembly as claimed in claim 16, wherein a portion of said housing does not belong to said soldering region and said portion is also offset from the center of geometry.

18. The electrical connector assembly as claimed in claim 17, wherein a recess is formed in said portion.

19. The electrical connector assembly as claimed in claim 17, wherein said portion is surrounded by said soldering portion.

20. The electrical connector assembly as claimed in claim 17, wherein said portion is offset from the center of geometry toward a level which is moveable relative to the housing.

* * * * *